US011058149B2

(12) United States Patent
Zheng et al.

(10) Patent No.: US 11,058,149 B2
(45) Date of Patent: Jul. 13, 2021

(54) SMOKING PARAPHERNALIA COOLED BY SMOKE FLOW

(71) Applicant: CHINA TOBACCO YUNNAN INDUSTRIAL CO., LTD, Kunming (CN)

(72) Inventors: Xudong Zheng, Kunming (CN); Jianguo Tang, Kunming (CN); Zhiqiang Li, Kunming (CN); Ping Lei, Kunming (CN); Shanzhai Shang, Kunming (CN); Jingmei Han, Kunming (CN); Chengya Wang, Kunming (CN); Ru Wang, Kunming (CN); Xu Zeng, Kunming (CN); Dalin Yuan, Kunming (CN); Yongkuan Chen, Kunming (CN); Mingming Miao, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 184 days.

(21) Appl. No.: 16/503,649

(22) Filed: Jul. 5, 2019

(65) Prior Publication Data

US 2021/0000171 A1 Jan. 7, 2021

(51) Int. Cl.
*A24F 13/08* (2006.01)
*A24F 13/06* (2006.01)

(52) U.S. Cl.
CPC ..... *A24F 13/06* (2013.01); *A24F 13/08* (2013.01)

(58) Field of Classification Search
CPC ..... A24F 13/06; A24F 13/08; A24F 13/02; A24F 13/00
See application file for complete search history.

(56) References Cited

U.S. PATENT DOCUMENTS 5,353,814 A * 10/1994 Martin ..... A24F 13/00 131/175
2015/0325938 A1* 11/2015 Wu ..... H01R 13/111 439/851
2016/0007649 A1* 1/2016 Sampson ..... A24F 13/06 131/187

FOREIGN PATENT DOCUMENTS

CN 104135881 A 11/2014

* cited by examiner

*Primary Examiner* — Michael J Felton
*Assistant Examiner* — Stephanie Lynn Moore
(74) *Attorney, Agent, or Firm* — Bayramoglu Law Offices LLC

(57) ABSTRACT

A smoking paraphernalia cooled by a smoke flow includes the following components: a shell; a smoking cup placed inside the shell, wherein a part of a bottom of the smoking cup is provided with a heating unit socket, a plurality of air inlet holes and a protruded step; a pushing key; a heating unit; and a fixing base. According to the smoking paraphernalia of the present invention, a surface temperature of the shell can be reduced, and tobacco residues can be conveniently cleaned, which prevents smoke from flowing toward an interior of the smoking paraphernalia and prolongs the service life of the smoking paraphernalia.

6 Claims, 2 Drawing Sheets

SMOKING PARAPHERNALIA COOLED BY SMOKE FLOW

TECHNICAL FIELD

The present invention belongs to the technical field of cigarettes, and specifically relates to a smoking paraphernalia cooled by a smoke flow.

BACKGROUND

In the developed novel smoking paraphernalia, the shell of the smoking paraphernalia gets heated to an excessive temperature, thus making it difficult for a consumer to hold the smoking paraphernalia by hand, which is a perplexing problem for researchers. Thereinto, compared with adding heat insulation material or enlarging designed volume of the smoking paraphernalia, an airflow channel cooling design has been popular among most of the researchers. The airflow channel of the novel smoking paraphernalia is generally designed for the airflow to enter from a bottom or a side surface and eventually flow out from an outlet of a heating cavity. There is no circular airflow existing in this designed structure, meanwhile, an air vent needs to be provided beside a heating unit fixing base, and the air vent forms a channel for air to flow. However, the provided air vent is readily blocked by tobacco residues, causing the air unable to flow smoothly when smoking, thus the blockage in the air vent needs to be cleaned frequently. At the same time, as the airflow channel is designed for air to enter from the bottom and the side surface, the hot air produced in a frequent and a long time of smoking is prone to accumulate inside the heating cavity, causing the shell of the smoking paraphernalia to have the excessive temperature, severely affecting smoking experience.

Additionally, when a cigarette is inserted into the smoking paraphernalia, though it is not in a smoking state, the heating unit heating the tobacco will produce a great deal of smoke, and the smoke permeates out through an inner wall and the outer airflow channel. The smoke carries a great deal of tar, water, and other liquids, and these liquids flowing to the interior of the smoking paraphernalia will cause a short circuit of a circuit board, shortening the service life of the smoking paraphernalia.

A patent of Philip Morris International having an application number of CN201280070578.3 discloses an aerosol generating device and system with improved airflow, wherein the airflow channel is designed to let the air enter through a gap between a smoking cup and a shell of the smoking paraphernalia and flow out of the smoking paraphernalia. This structural design still makes a holding portion of the smoking paraphernalia hot, failing to reduce the temperature of the shell of the smoking paraphernalia. Besides, apertures used in pair are prone to increase the resistance of suction, causing an unsatisfactory smoking experience. The prior art has the following drawbacks: for the airflow channel of the existing novel smoking paraphernalia on the market, heat produced by smoking cannot be carried away by airflow when subjected to a frequent smoking, which causes the excessive temperature of the shell of the smoking paraphernalia; moreover, for most of the airflow channel of the existing novel smoking paraphernalia available on the market, the air enters from the bottom or the side surface, and the tobacco residues are prone to block the airflow, causing an unsmooth smoking; tar, water, and other liquids will flow into the smoking paraphernalia, causing the short circuit of the circuit board, and shortening the service life of the smoking paraphernalia.

SUMMARY

To solve the above problems, the present invention provides a smoking paraphernalia cooled by a smoke flow.

The objectives of the present invention are realized by the following technical solutions.

A smoking paraphernalia cooled by the smoke flow includes the following components:

a shell, wherein openings at two ends of the shell are cylindrical;

a smoking cup placed inside the shell, wherein there is a gap between an opening of the smoking cup and an opening of the shell to form an air inlet, an annular gap is formed between an outer wall of the smoking cup and an inner wall of the shell, a part of a bottom of the smoking cup is provided with a heating unit socket, a plurality of air inlet holes and a protruded step;

a pushing key, wherein an upper end surface of the pushing key abuts against the step, the pushing key and the bottom of the smoking cup form a gap;

a heating unit, wherein the heating unit penetrates through the heating unit socket and enters the smoking cup; and a fixing base, wherein the fixing base is provided with a plurality of fixing base air vents, each of the fixing base air vents is provided with a one-way leaf spring 10.

Preferably, there is a gap between the heating unit and the heating unit socket.

During use, the smoking cup contains a smoke product. An end of the smoke product is inserted into the smoking cup, and the other end of the smoke product is a cigarette filter. An airflow channel is provided inside the smoke product 1.

The heating unit is inserted into the smoke product from the end of the smoke product, and the heating unit heats the interior of the smoke product.

Preferably, the smoking paraphernalia further includes a spring. Two ends of the spring abut between an inner flange of the opening of the shell and an outer protruded ring of the outer wall of the smoking cup.

Preferably, the heating unit is fixed inside the fixing base. A lower end surface of the pushing key abuts against the fixing base.

Preferably, the shell is made of heat insulation material.

Preferably, the fixing base air vents are connected to the air inlet holes. Namely, when smoking, the one-way leaf spring is opened upward. The airflow can enter from the fixing base air vents, and then enter the smoking cup through the air inlet holes.

The working principle of the smoking paraphernalia of the present invention is as follows: when a smoker smokes the cigarette, air enters the annular gap from the air inlet and is heated by the outer wall of the smoking cup, then the air reaches the gap formed by the pushing key and the bottom of the smoking cup, and enters the smoking cup through the gap between the heating unit and the heating unit socket and the air inlet holes, subsequently, the air enters the airflow channel inside the smoke product and enters a mouth of the smoker through the cigarette filter.

When the smoker is smoking, the one-way leaf springs of the fixing base air vents are opened upward. Air can also enter from the fixing base air vents, then enter the smoking cup via the air inlet holes. At that time, the air entering the fixing base air vents can take away heat and realize the purpose of cooling. When the smoker is not smoking, since the fixing base air vents are provided with the one-way leaf spring which only allows the airflow to enter the smoking cup, the smoke is prevented from flowing toward an interior of the smoking paraphernalia, solving the problem of short circuit of the circuit board caused by the smoke flowing into the smoking paraphernalia in the prior art, and thus, prolonging the service life of the smoking paraphernalia.

Additionally, since two ends of the spring abut between the inner flange of the opening of the shell and the outer protruded ring of the outer wall of the smoking cup, the smoking cup can be pushed toward the opening by the pushing key. The bottom of the smoking cup can move back and forth with respect to the heating unit fixing base, thus the tobacco residues are readily cleaned, and the airflow channel will not be blocked by the tobacco residues.

The present invention has the following advantages:

(1) When smoking, using the smoking paraphernalia of the present invention, the airflow enters from the shell and the air inlets of the smoking cup, passes through the annular gap between the shell and the smoking cup, enters the heating cavity inside the smoking cup through the gap formed between the pushing key and the bottom of the smoking cup, and then passes through the airflow channel inside the smoke product to enter the mouth of the smoker through the cigarette filter. This circular airflow design makes the hot air in an outer wall area of the smoking cup be taken away, thereby reducing the temperature of the outer surface of the shell, and preventing the shell from being too hot.

(2) The smoking cup of the smoking paraphernalia of the present invention can move back and forth with respect to the heating unit fixing base through the pushing key, thus the situation of blocking of the smoking paraphernalia will not occur. It overcomes the drawback of the existing smoking paraphernalia, where the airflow channel is prone to get blocked by the tobacco residues, avoiding the trouble of frequently cleaning the blockage in the airflow channel when the smoking process isn't smooth.

(3) When the cigarette is not in a smoking state, the heating unit heats the tobacco and produces a great deal of smoke. The smoke permeates out through the airflow channel of the smoking cup, wherein the smoke carries a great amount of tar, water, and other liquids, these liquids flow into the smoking paraphernalia and will thus cause a short circuit of the circuit board, shortening the service life of the smoking paraphernalia. According to the smoking paraphernalia of the present invention, since the fixing base air vents are provided with the one-way leaf spring which only allows the airflow to enter the smoking cup, the smoke is prevented from flowing into the smoking paraphernalia, solving the problem of short circuit of the circuit board caused by the smoke flowing into the smoking paraphernalia in the prior art, and thus, prolonging the service life of the smoking paraphernalia.

Figure 1:
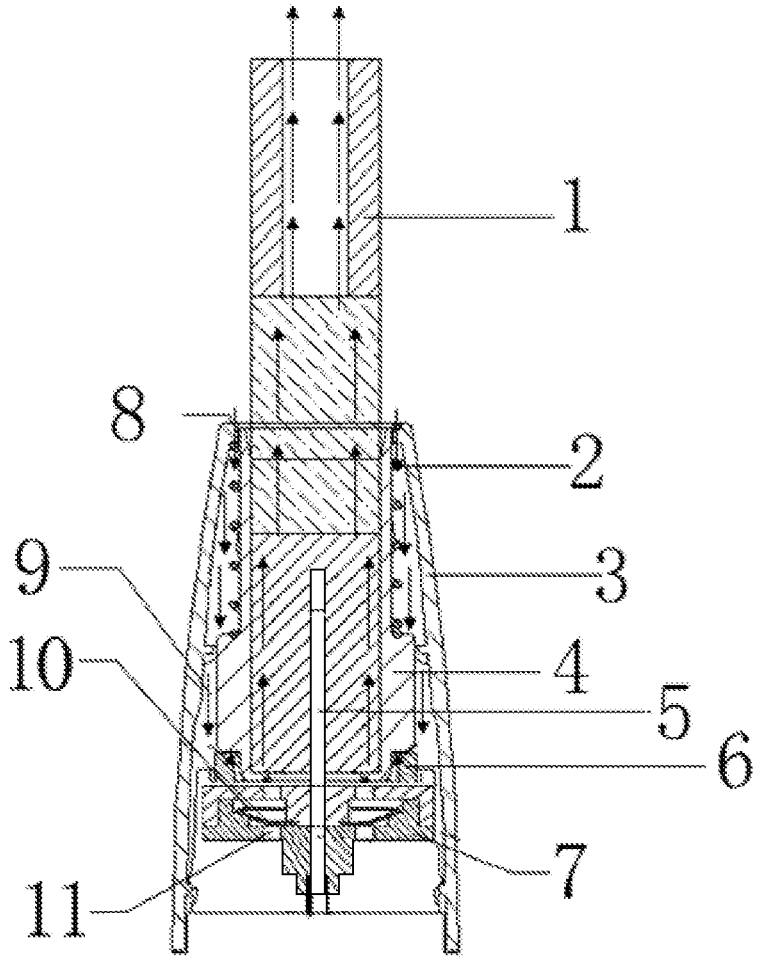
FIG. 1 is a schematic diagram showing an air flowing process of a smoking paraphernalia cooled by a smoke flow according to the present invention.
Figure 2:
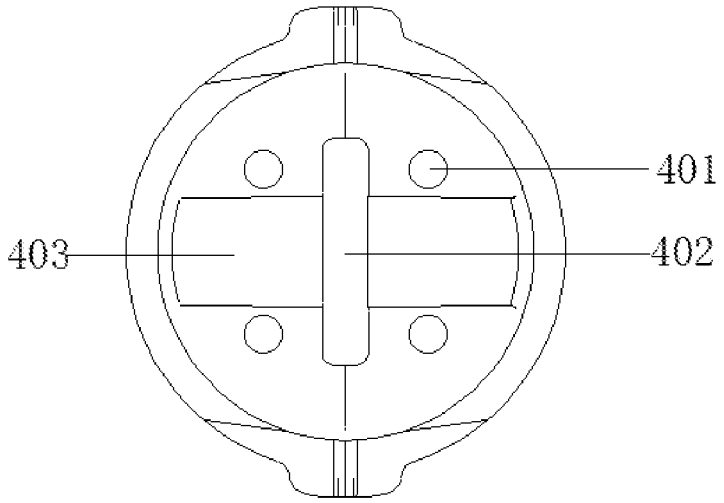
FIG. 2 is a bottom view showing a bottom of a smoking cup of the smoking paraphernalia cooled by the smoke flow according to the present invention.
Figure 3:
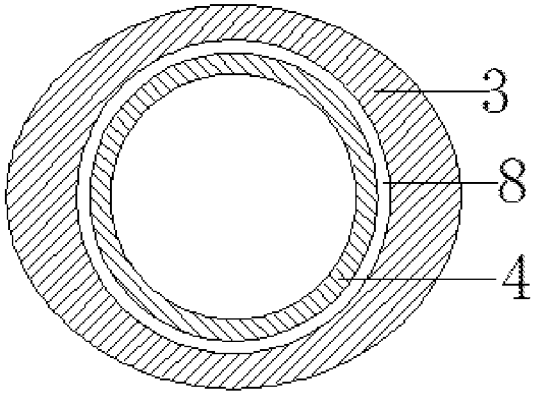
FIG. 3 is a top view showing an opening of the smoking paraphernalia cooled by the smoke flow according to the present invention.

The reference designators in the drawings are described below: 1, smoke product, 2, spring, 3, shell, 4, smoking cup, 5, heating unit, 6, pushing key, 7, fixing base, 8, air inlet, 9, annular gap, 401, air inlet hole, 402, heating unit socket, 403, step, 10, one-way leaf spring, 11, fixing base air vent.

DETAILED DESCRIPTION OF THE EMBODIMENTS

A smoking paraphernalia cooled by a smoke flow includes the following components:

the shell 3, wherein openings at two ends of the shell 3 are cylindrical; the smoking cup 4 is placed inside the shell 3, wherein there is a gap between an opening of the smoking cup 4 and an opening of the shell 3 to form the air inlet 8, an outer wall of the smoking cup 4 and an inner wall of the shell 3 form the annular gap 9, and a part of a bottom of the smoking cup is provided with the heating unit socket 402, a plurality of air inlet holes 401 and a protruded step 403; the pushing key 6, wherein an upper end surface of the pushing key abuts against the step 403, and the pushing key and the bottom of the smoking cup 4 form a gap; the heating unit 5, wherein the heating unit penetrates through the heating unit socket 402 and enters the smoking cup 4, and there is a gap between the heating unit 5 and the heating unit socket 402; and the fixing base 7, wherein the fixing base is provided with a plurality of fixing base air vents 11, and each of the fixing base air vents 11 is provided with a one-way leaf spring 10. One end of the smoke product 1 is inserted in the smoking cup 4, and the other end thereof is a cigarette filter. An airflow channel is provided inside the smoke product.

Preferably, the smoking paraphernalia further includes the spring 2. Two ends of the spring abut between an inner flange of the opening of the shell 3 and an outer protruded ring of the outer wall of the smoking cup 4.

Preferably, the heating unit 5 is fixed inside the fixing base 7. A lower end surface of the pushing key 6 abuts against the fixing base 7.

Preferably, the shell 3 is made of heat insulation material.

Preferably, the fixing base air vents 11 are connected to the air inlet holes 401. Namely, when smoking, the one-way leaf spring 10 is opened upward. The airflow can enter from the fixing base air vents 11, and then enter the smoking cup 4 through the air inlet holes 401.

The working principle of the smoking paraphernalia of the present invention is as below: when a smoker is smoking, air enters the annular gap 9 from the air inlet 8 and is heated by the outer wall of the smoking cup 4, then reaches the gap from by the pushing key 6 and the bottom of the smoking cup 4, then enters the smoking cup 4 through the gap between the heating unit 5 and the heating unit socket 402 and the air inlet holes 401, and then enters the airflow channel of the smoke product 1 and a mouth of the smoker through the cigarette filter.

When the smoker is smoking, the one-way leaf springs 10 of the fixing base air vents 11 are opened upward. The air can also enter through the fixing base air vents 11. At that time, the purpose of cooling can be achieved. When the smoker is not smoking, since the fixing base air vents 11 are provided with the one-way leaf spring 10 which only allows the airflow to enter the smoking cup, the smoke is prevented from flowing into the smoking paraphernalia, solving the problem of the short circuit of the circuit board caused by the smoke flowing into the smoking paraphernalia in the existing smoking paraphernalia, and thus, prolonging the service life of the smoking paraphernalia.

Additionally, since two ends of the spring 2 abut between the inner flange of the opening of the shell 3 and the outer protruded ring of the outer wall of the smoking cup 4. The smoking cup 4 can be pushed toward the opening by the pushing key 6. The bottom of the smoking cup 4 can move back and forth with respect to the heating unit fixing base 7, thus the tobacco residues are readily cleaned, and the airflow channel will not be blocked by the tobacco residues.

What is claimed is:

1. A smoking paraphernalia cooled by a smoke flow, comprising:

a shell, wherein openings at two ends of the shell are cylindrical;

a smoking cup positioned inside the shell, wherein there is a first gap between an opening of the smoking cup and a first opening of the openings at two ends of the shell to form an air inlet, an annular gap is formed between an outer wall of the smoking cup and an inner wall of the shell; a part of a bottom of the smoking cup is provided with a heating unit socket, a plurality of air inlet holes and a protruded step;

a pushing key, wherein an upper end surface abuts against the step, the pushing key and the bottom of the smoking cup form a second gap;

a heating unit, wherein the heating unit penetrates through the heating unit socket and enters the smoking cup; and a fixing base, wherein the fixing base is provided with a plurality of fixing base air vents, each of the plurality of fixing base air vents is provided with a one-way leaf spring to allow airflow only to enter the smoking cup.

2. The smoking paraphernalia cooled by the smoke flow according to claim 1, further comprising a spring, two ends of the spring abut between an inner flange of the first opening of the shell and an outer protruded ring of the outer wall of the smoking cup.

3. The smoking paraphernalia cooled by the smoke flow according to claim 1, wherein the heating unit is fixed inside the fixing base, a lower end surface of the pushing key abuts against the fixing base.

4. The smoking paraphernalia cooled by the smoke flow according to claim 1, wherein the shell is made of a heat insulation material.

5. The smoking paraphernalia cooled by the smoke flow according to claim 1, wherein there is a gap between the heating unit and the heating unit socket to allow air to enter the smoking cup.

6. The smoking paraphernalia cooled by the smoke flow according to claim 1, wherein the plurality of fixing base air vents are interconnected to the plurality of air inlet holes.

* * * * *